US008118696B2

(12) United States Patent
Martin et al.

(10) Patent No.: US 8,118,696 B2
(45) Date of Patent: Feb. 21, 2012

(54) VIRTUAL SHUFFLEBOARD

(75) Inventors: John R. Martin, Rockford, IL (US); Patrick G. Rice, Loves Park, IL (US); Matthew S. Malmberg, Rockford, IL (US); Richard F. Jones, Rockford, IL (US)

(73) Assignee: Arachnid Inc., Rockford, IL (US)

( * ) Notice: Subject to any disclaimer, the term of this patent is extended or adjusted under 35 U.S.C. 154(b) by 42 days.

(21) Appl. No.: 12/823,634

(22) Filed: Jun. 25, 2010

(65) Prior Publication Data

US 2010/0279804 A1 Nov. 4, 2010

Related U.S. Application Data

(63) Continuation-in-part of application No. 12/563,370, filed on Sep. 21, 2009.

(60) Provisional application No. 61/111,399, filed on Nov. 5, 2008.

(51) Int. Cl.
*A63B 71/02* (2006.01)

(52) U.S. Cl. ..... 473/588

(58) Field of Classification Search ..... 473/588, 473/589

See application file for complete search history.

(56) References Cited

U.S. PATENT DOCUMENTS

| | | | | |
|---|---|---|---|---|
| 1,963,956 | A | 6/1934 | Graig | |
| 3,954,267 | A | 5/1976 | Freeman et al. | |
| 4,696,583 | A | 9/1987 | Gorges | |
| 4,801,144 | A | 1/1989 | De Masi, Jr. et al. | |
| 4,983,417 | A | 1/1991 | Dunn | |
| 5,033,601 | A | 7/1991 | Huber | |
| 5,275,410 | A | 1/1994 | Bellehumeur et al. | |
| 5,284,343 | A | 2/1994 | Bigornia et al. | |
| 5,429,359 | A | 7/1995 | Timperman et al. | |
| 5,518,238 | A | 5/1996 | Hu et al. | |
| 5,531,442 | A * | 7/1996 | Gill | 473/588 |
| 5,533,604 | A | 7/1996 | Brierton | |
| 5,540,314 | A | 7/1996 | Coelln | |
| 5,733,213 | A * | 3/1998 | Colarusso | 473/588 |
| 5,792,012 | A | 8/1998 | Dudley | |
| 5,976,042 | A * | 11/1999 | LaMarche et al. | 473/588 |
| 6,152,842 | A | 11/2000 | Licursi | |
| 6,248,034 | B1 * | 6/2001 | Voloshen | 473/588 |
| 6,435,468 | B1 | 8/2002 | Simchoni | |
| 6,645,097 | B2 | 11/2003 | Samuel et al. | |
| 7,007,787 | B2 | 3/2006 | Pallini et al. | |
| 2010/0113197 | A1 * | 5/2010 | Martin et al. | 473/588 |
| 2010/0279804 | A1 * | 11/2010 | Martin et al. | 473/588 |

* cited by examiner

*Primary Examiner* — Raleigh W. Chiu

(74) *Attorney, Agent, or Firm* — McAndrews, Held & Malloy, Ltd.

(57) ABSTRACT

A virtual shuffleboard table gaming apparatus including a housing having a playing field, a game acquisition circuit, and a display. As a puck is propelled towards a puck return at the distal end of the playing field, the puck temporarily obstructs at least two beams from transmitters. Sensors that receive the transmitted beams provide information to the game acquisition circuit indicative of the time when the beams were blocked and unblocked. The duration of time the beams are block are used by a game controller to calculate the angle of travel, location, and velocity of the puck. This information is then used by the game controller to determine the travel path and resting place of a virtual puck on a virtual playing field, as well as determine whether the virtual puck rests in a scoring zone and maintain a game score.

15 Claims, 8 Drawing Sheets

VIRTUAL SHUFFLEBOARD

RELATED APPLICATIONS

This application is a continuation-in-part of U.S. application Ser. No. 12/563,370, filed on Sep. 21, 2009, which claims the benefit of U.S. Provisional Application No. 61/111,399, filed Nov. 5, 2008, both of which are incorporated herein by reference in their entirety.

BACKGROUND OF THE INVENTION

Embodiments of the present invention relate to amusement devices in which a player propels a puck along a partial horizontal playing field surface towards a virtual scoring zone that is demarcated into areas of differing score value.

Traditional shuffleboards typically require a lengthy playing field, which is often demarcated on a floor, paved surface, or similar surfaces, such as, for example, the decks of ships. Elongated tables on which shuffleboard is also played have been developed for use in game arcades or other indoor locations, such as bars and pubs.

When playing table shuffleboard, players slide pucks along a playing field surface towards a scoring zone at the opposing far end of the table. The scoring zone of the table is typically demarcated into areas of different score value. A player's score is determined by the sum of the score values of areas where the player's puck(s) comes to rest. As a matter of strategy, competing players may endeavor to dislodge an opponent's puck from scoring areas through contact with their own puck. However, in conventional table shuffleboards, the speed of travel of the puck is gradually slowed by friction as the puck slides along the table. Players must therefore anticipate the rate at which the puck will slow when sliding the puck along the surface of the playing field so that the puck may come to rest in an area of highest score value.

Prior table shuffleboard games have several characteristics that tend to restrict their use or which have detracted from players' enjoyment of the game. For example, in commercial game arcades, a shuffleboard table competes for available space with a variety of other games. Moreover, it is customary for table shuffleboard games have lengthy playing fields, typically at least 12 to 24 feet long, so as to make the game sufficiently challenging. Shuffleboard tables also require frequent leveling and climate calibration to ensure consistent and true puck travel.

Additionally, sufficient lighting may not always be present at locations where it is desired to situate a table shuffleboard game. Therefore, the table shuffleboard playing field may typically be illuminated so that the field boundaries and demarcations on the field are clearly visible to players. Some prior shuffleboard game tables attempt to resolve this problem by including lighting fixtures as a component of the table itself. For example, the fixtures may be mounted on posts that extend upward at a side of the playing field. However, the inclusion of such fixtures further contributes to the bulk of the table shuffleboard game.

Shuffleboard tables also typically have a scoreboard in the form of a display screen which indicates each player's current score. However, the players have the burden of both calculating scores and scorekeeping. For example, the players must remember to manually operate the electrical switch buttons that operate the scoreboard. Such scoreboards are typically mounted on posts that extend upward from a side of the table, and thereby further contribute to the bulk of the table shuffleboard game.

Another disadvantage of table shuffleboard games in commercial establishments is the ability of players to play or practice the game without paying for game play. Such activities are possible as payment for game play simply activates the electronic scoreboard display. Since scoring is already manually performed by players, the scoreboard is not a necessity for playing or practicing the game. Prior attempts to address this problem have included upwardly extending a row of pins at the middle of the playing field which are retracted upon the deposit of sufficient money or credits for a game play session.

Pucks used in conventional table shuffleboard games are relatively heavy so as to allow the player to impart sufficient momentum to the puck to have the puck travel along the full length of the playing field. These heavy pucks often abrade the surface of the playing field, which eventually interferes with smooth sliding of the pucks, and thereby detracts from the quality of the game. Such abrading of the surface of the playing field also complicates maintenance of these tables, as frequent resurfacing of the playing field may become necessary. Some table shuffleboard games have a protective plastic on top of the game playing field to eliminate the need for such maintenance, but however typically require the application of silicone beads to the playing field to reduce friction between the playing field and puck. Further, such silicone beads are typically spread on the game playing field by players as needed throughout each game, which necessitates that these silicone beads be readily available for use by the players. Such maintenance and supply of silicone beads increases the costs of operating table shuffleboards.

Traditional table shuffleboard games are also limited to a single form or play and a single scoring protocol. Specifically, the demarcations at the end regions of the playing field that are used for scoring are permanently imprinted on the playing field surface. Accordingly, the inability to change or modify these permanently imprinted demarcations limits the shuffleboard game to a single form or play and a single scoring protocol.

Shuffleboard-like video games often incorporate a multidimensional ball control transducer, known as a track ball, to enable a player to specify travel and velocity parameters. However, these games break from the tradition of table shuffle board by removing the kinesthetic link of propelling actual pucks along the surface of a playing field. Additionally, profitability of a gaming apparatus in commercial game arcades or the like is highly dependent on the ability of the game to attract the interest of potential players and to provide an exciting ambiance during playing of the game. However, prior shuffleboard tables and shuffleboard-like video games have been lacking in this respect.

BRIEF SUMMARY OF THE INVENTION

One aspect of the present invention is a gaming apparatus that includes a housing having a playing field. The playing field may have a proximate end and a distal end. A display may be operably connected to the housing. The gaming apparatus may also include a puck return that is operably connected to the distal end of the playing field. The puck return may be configured to return a puck propelled down the playing field back to approximately the proximate end of the playing field. According to an embodiment of the invention, the playing field may have a resilient elastic material placed above the playing field. The gaming apparatus may also include a first transmitter and a first sensor. The first transmitter and the first sensor may be positioned on opposite sides of the playing field. The first transmitter is configured to transmit a first beam to the first sensor, and the first sensor configured to read the first beam. The gaming apparatus may also include a second transmitter and a second sensor, the second transmitter and second being positioned on opposite sides of the playing surface. The second transmitter is configured to transmit a second beam to the second sensor, and the second sensor configured to read the second beam. According to an embodiment of the present invention, the first beam and the second beam are oriented to intersect at approximately the center of the width of the playing field.

Another aspect of the present invention is a gaming apparatus having a housing, a first and second transmitter operably connected to the housing, and a first and second sensor operably connected to the housing. The first transmitter is configured to transmit a first beam to the first sensor, and the second transmitter configured to transmit a second beam to the second sensor. Further, the first and second beams may have an intersection point at approximately the center of the width of the playing field. The gaming apparatus also includes a game acquisition circuit having a game controller. The game acquisition circuit is operably connected to the first and second sensors. The first sensor is configured to provide signals to the game acquisition circuit indicating changes in a first beam status, and the second sensor is configured to provide signals to the game acquisition circuit indicating changes in a second beam status. Further, the game acquisition circuit is adapted to set times indicating when the changes in the first and second beam statuses occur. The game controller is also adapted to use the times equated to the changes in the first and second beam statuses to calculate at least one of the following: the angle of travel, velocity, or location of a puck propelled across the first and second beams. The game acquisition circuit may use the calculated angle of travel, velocity, and/or location of the puck to determine the travel path of a virtual puck along a virtual playing field, and display the virtual puck on a display.

Another aspect of the present invention is a gaming apparatus including a housing having a first side rail, a second side rail, and a playing field. The playing field may have a proximate end and a distal end. A puck return is operably connected to the housing and includes an elastic resilient elastic material placed above a portion of the distal end of the playing field. A first transmitter is operably connected to the first side rail, while a second transmitter operably connected to the second side rail. The first transmitter is configured to transmit a first laser beam, and the second transmitter configured to transmit a second laser beam. The first laser beam is oriented to intersect the second laser beam at approximately the center of the width of the playing field. A first sensor, which is oriented to read the first laser beam, is operably connected to the second side rail. A second sensor, oriented to read the second laser beam, is operably connected to the first side rail. The gaming apparatus also includes a game acquisition circuit that is adapted to receive at least two interrupt signals from both the first and second sensors. At least one of interrupt signals received by the game acquisition circuit for the sensors indicates the first sensor or second sensor is unable to read the first or second laser beam. Additionally, at least one of the interrupt signals received by the game acquisition circuit indicates when the first or second sensors have resumed being able to read the first or second laser beam. The game acquisition circuit is also adapted to record a time associated with each of the interrupt signals received by the game acquisition circuit.

BRIEF DESCRIPTION OF SEVERAL VIEWS OF THE DRAWINGS

FIG. 3(*b*) illustrates a perspective view of the playing field and housing of a gaming apparatus having a puck catcher according to an embodiment of the present invention.

Figure 2:
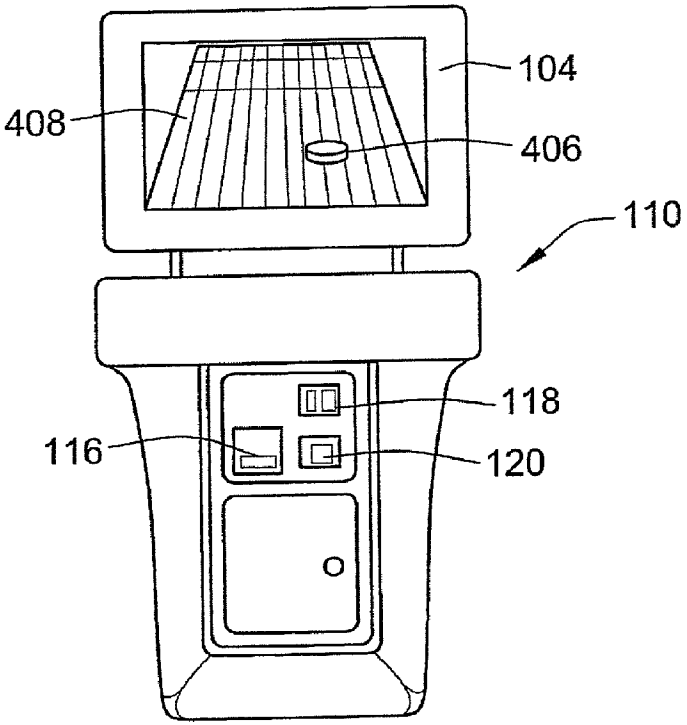
FIG. 2 is a front view of a gaming apparatus according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

Figure 1:
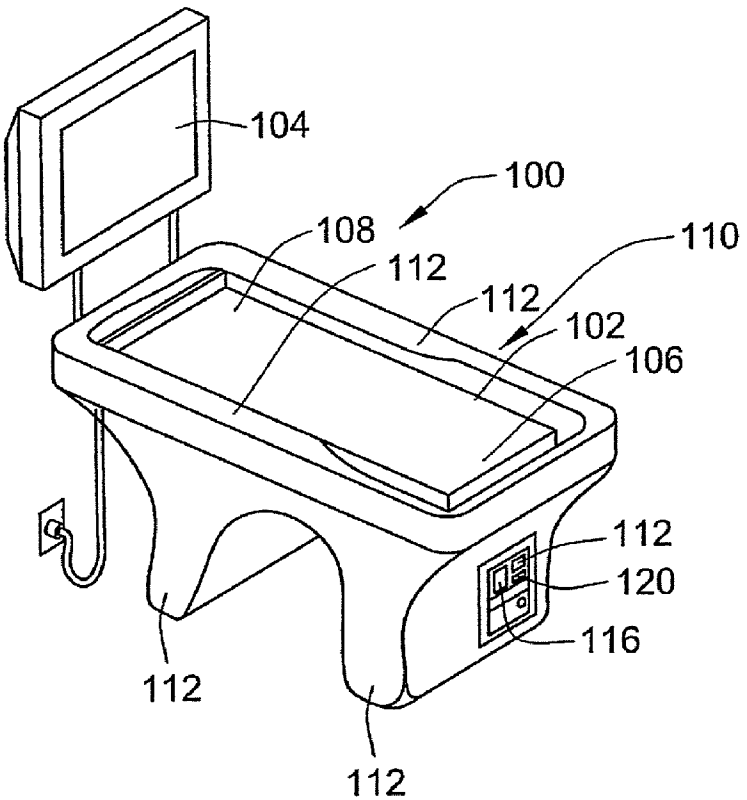
FIG. 1 illustrates a perspective view of a gaming apparatus according to an embodiment of the present invention.

FIGS. 1 and 2 illustrate a perspective view and a front view, respectively, of a gaming apparatus 100 according to an embodiment of the present invention. The gaming apparatus 100 includes a playing field 102 and a display 104, such as a video monitor. The playing field 102 includes a proximate end 106 and a distal end 108. According to an embodiment of the present invention, the playing field 102 may be a portion of the playing field of a conventional table shuffleboard, such as, for example, a portion of the playing field of a table shuffleboard that is in proximity to where a player typically releases a puck onto the playing field. For example, the playing field 102 may have a construction similar to conventional 12 to 24 foot long wooden shuffleboard table but have a length of approximately 50 inches. However, the present invention may be used with a variety of different lengths for the playing field 102.

The display 104 may be mounted to the housing 110, such as, for example, through mounting brackets or posts, among others. Alternatively, the display 104 may be mounted on a wall or other nearby vertical surface or suspended from a ceiling or overhanging structure. The housing 110 may also include, or be supported by, legs 112, as shown in FIGS. 1 and 2.

Figure 3A:
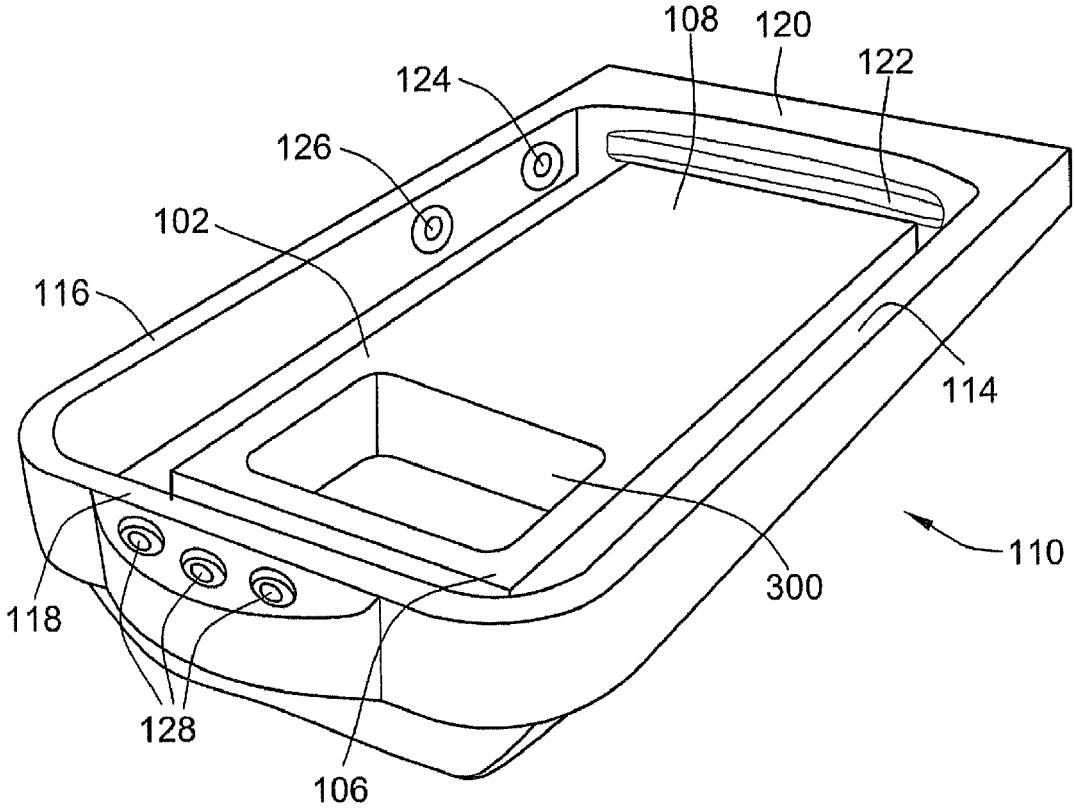
FIG. 3(*a*) illustrates a perspective view of the playing field and housing of a gaming apparatus having a puck return according to an embodiment of the present invention.
Figure 3B:
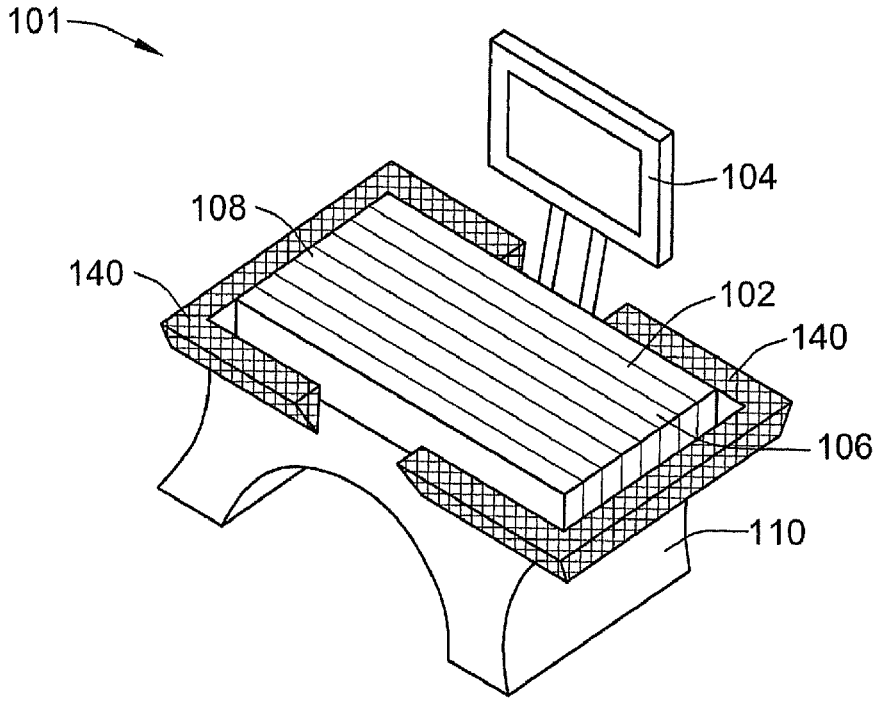

FIG. 3(*a*) illustrates a perspective view of the playing field 102 and housing 110 of a gaming apparatus 100 according to an embodiment of the present invention. The playing field 102 may be set in or on the housing 110. According to an embodiment of the present invention, the housing 110 may include a first side rail 114, a second side rail 116, a first end rail 118, and a second end rail 120. The first and second side rails 114, 116 may be generally parallel to at least a portion of the sides of the playing field 102, as illustrated in FIG. 3(*a*). Additionally, at least a portion of the side rails 114, 116 may abut against, or, alternatively, be offset by gutters from the sides of the playing field 102. According to an embodiment of the present invention, at least a portion of the first end rail 118 may be recessed so as to not interfere with a player's movement when the player releases, or prepares to release, a puck onto the playing field 102. According to another embodiment, the housing may not have side rails 114, 116 and/or end rails 118, 120. Instead, the sides of the playing field may abut against gutters or nets that may catch a puck that may fall over the edge of the playing field 102.

The housing 110 may also include player activated buttons 128. The player activated buttons 128 may allow the player to make menu and game play selections, including, for example, selecting the number of players for game play and the type of game to be played, such as, for example, Knock Off, Crazy Eights, Horse Collar, Target, Baseball, bowling, and skee ball, among others. For example, according to an embodiment of the invention, the type of game to be played may include selecting scoring zones and values, and the player may select the length of the virtual playing field 408. According to another embodiment, a player activated button 128 may allow a player to add "English," or a spin factor, on the movement of the puck 200. For example, the gaming apparatus 100 may be programmed so that the length of time the player holds down a player activated button 128 may translate to the amount of spin factor added to the movement of the virtual puck 406.

Figure 6:
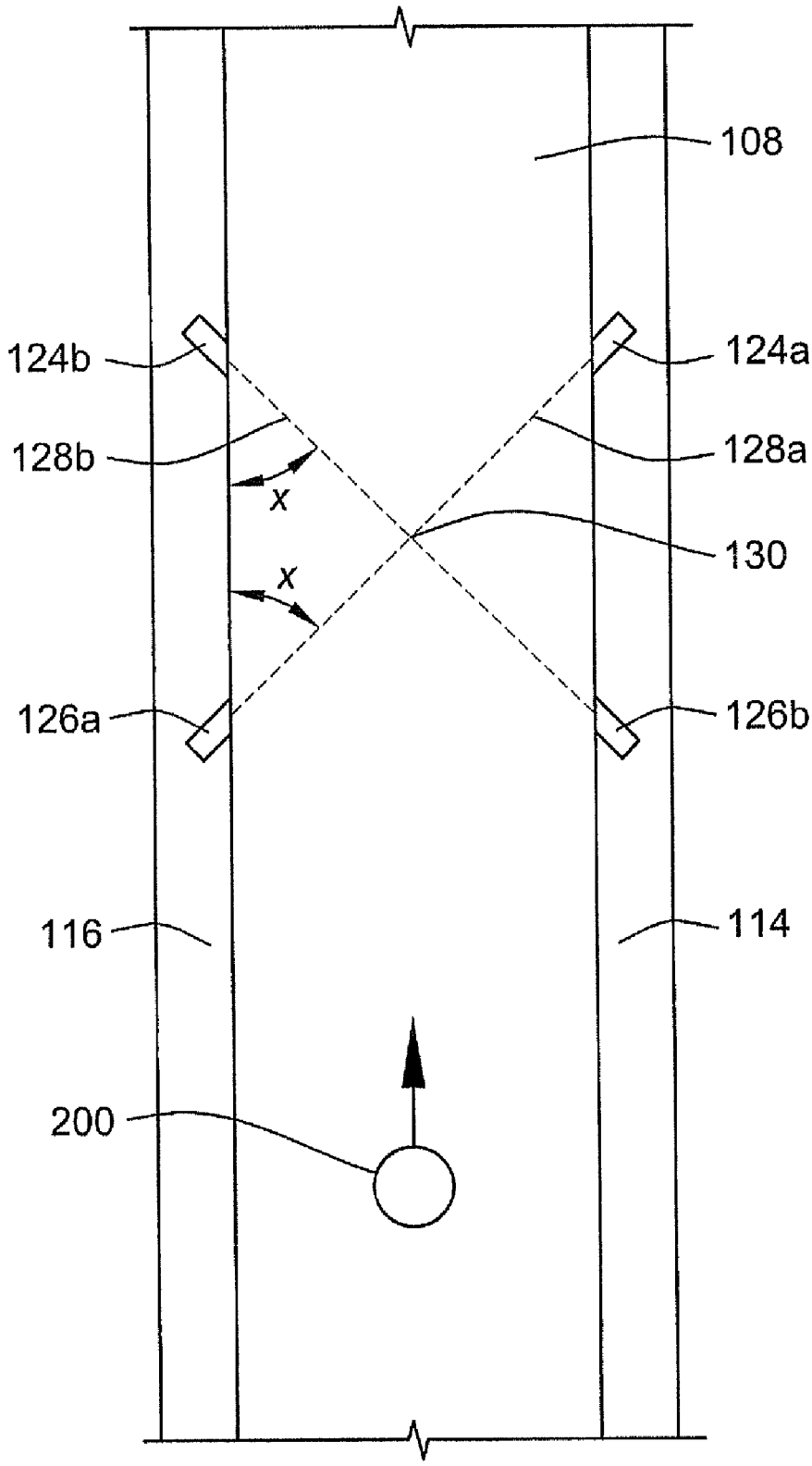
FIG. 6 illustrates a representation of a puck traveling along a playing field according to an embodiment of the present invention.

The first and second side rails 114, 116 may include one or more transmitters 124*a*, 124*b* and one or more sensors 126*a*, 126*b*, as shown in FIG. 6. Alternatively, the transmitters 124*a*, 124*b* and/or sensors 126*a*, 126*b* may be located on posts or be operably attached to the playing field 102 or housing 110, such as, for example, being mechanically mounted or fastened to the sides, edges, and/or the horizontal playing surface of the playing field 102, among others. Each transmitter 124*a*, 124*b* may be oriented toward the associated sensor 126*a*, 126*b*, and vice versa. Further, different types of transmitters 124*a*, 124*b* and the associated sensors 126*a*, 126*b* may be used for the transmission of a beam 128*a*, 128*b* from the transmitters 124*a*, 124*b* to the sensors 126*a*, 126*b*, including, for example, but not limited to, an optical, LED, infrared, or laser beam, among others. The sensors 126*a*, 126*b* may be solar sensors or analog sensors that read the intensity of the transmitted beam 128*a*, 128*b* and/or digital sensors that read whether the transmitted beam 128*a*, 128*b* is obstructed by a passing puck or unobstructed. According to an embodiment, two or more transmitters 124 may be mounted on the first or second side rails 114, 116, while the sensors are located on the opposite side rail 114, 116. Alternatively, each side rail 114, 116 may include at least one transmitter 124*a*, 124*b* and at least one sensor 126*a*, 126*b*. According to an embodiment, each side rail 114, 116 includes one sensor, with the sensors 126*a*, 126*b* being located closer than the transmitters 124*a*, 124*b* to the player playing the game. While the sensors and transmitters 124, 126 may be positioned anywhere along the first and second rails 114, 116, according to an embodiment, the sensors 126*a*, 126*b* and transmitters 124*a*, 124*b* may be positioned in general proximity to the distal end 108 of the playing field 102. Moreover, the sensors 126*a*, 126*b* and transmitters 124*a*, 124*b* may be positioned along the first and second side rails 114, 116 so that the movement of the player while propelling the puck towards the distal end 108 does not interfere with the ability of the transmitter 124*a*, 124*b* and/or sensor 126*a*, 126*b* to detect the movement of the puck and/or so as to not detect any movement of the player. Determination of the location of the sensors 126*a*, 126*b* and transmitters 124*a*, 124*b* may also be based on an at least the attempt to minimize any potential misalignment due to the movement of the housing 110 and/or playing field 102, such as movement caused by player contact with the housing 110 or playing field 102.

According to an embodiment of the present invention, the puck return 122 may be a resilient elastic material, such as, for example, urethane, at least a portion of which is stretched above and across to the playing field 102. For example, the puck return 122 may be located at the end of the playing field 102, and may be mechanically connected to the housing 110 or playing field 102, such as, for example, through the use of hooks, posts, or slots, among others. The puck return 122 may stop, and even reverse, the movement of a puck that has been propelled to the distal end 108 of the playing field 102. Specifically, as the momentum of the puck 200 and its associated force comes into contact with the elastic material of the puck return 122, the elastic material of the puck return 122 may move from a rest position to a deformed position. The elastic material of the puck return 122 may reach the deformed position when the resistance of the elastic material of the puck return 122 overcomes the force being imparted by the propelled puck. The puck return 122 may then begin to move back towards the rest position. The movement of the puck return 122 from the deformed position towards the rest position may impart a force on the puck to sling, or propel, the puck back towards the proximate end 106 of the playing field 102.

FIG. 3(*b*) illustrates a perspective view of the playing field 102 and housing 110 of a gaming apparatus 101 having a puck catcher 140 according to an embodiment of the present invention. According to an embodiment of the present invention, the housing 110 illustrated in FIG. 3(*b*) may not include side rails 114, 116 and/or end rails 118, 120. However, the puck catcher 140 may also be used in embodiments in which the housing 110 includes side rails 114, 116 and/or end rails 118, 120.

The puck catcher 140 may be part of the housing 110, or operably connected to the housing 110, such as by mechanical fasteners, hooks, or brackets, among others. According to certain embodiments of the invention, the puck catcher 140 may be a gutter or net that is generally located beneath or along at least a portion of the outer perimeter of the playing field 102, such as around at least a portion of the distal end 108 and/or at least a portion of the proximate end 106 of the playing field 102. According to an embodiment of the present invention, the puck catcher 140 may be located below the horizontal playing surface of the playing field 102 so that the puck catcher 140 does not interfere with pucks travelling along the edge of the playing field 102. A puck(s) that goes or falls off the edge of the playing field 102 may go into the puck catch 140, and may be later retrieved by a player(s).

Additionally, the use of a puck catcher 140 may allow for players to play from each end of the playing field 102. Specifically, during a first round of play, players may propel pucks from the proximate end 106 toward the distal end 108 of the playing field 102. At that end of that round, the player(s) may retrieve pucks that are located at the distal end of the playing field 102 or in the puck catcher 140. Rather than returning to the proximate end 106 of the playing field 102, the players may remain at the distal end 108, and may continue game play by propelling the puck(s) from the distal end 108 of the playing field 102 toward the proximate end 106. According to such an embodiment, the display 104 may be located at a position so that the display 104 does not interfere with the players' ability to play a game from both the proximate end 106 and the distal end 108 of the playing field 102, such as, for example, being located to the side of the housing 110, among others.

The housing 110 may also include payment collection devices, such as, for example a bill collector 116 and/or a coin collector 118, and may also include a coin return 120, as shown in FIG. 3(*a*). However, the gaming apparatus may be configured to accept other forms of money or credits, including for example, credit cards or cards on which information regarding credits available to the player for game play may be stored.

FIG. 3(*a*) also illustrates a cavity 300 beneath the playing field 102. According to an embodiment of the present invention, the cavity 300 may be used for the placement of a game acquisition circuit and other hardware used in the operation of the gaming apparatus 100. The cavity 300 may be covered by one or more cover plates, at least a portion of the cover plate being part of the playing field 102. However, the game controller may be located at a variety of other locations, including, for example, beneath the housing 110, on or inside the side of the housing 110, in or on the rear of the housing 110, among others.

Figure 4:
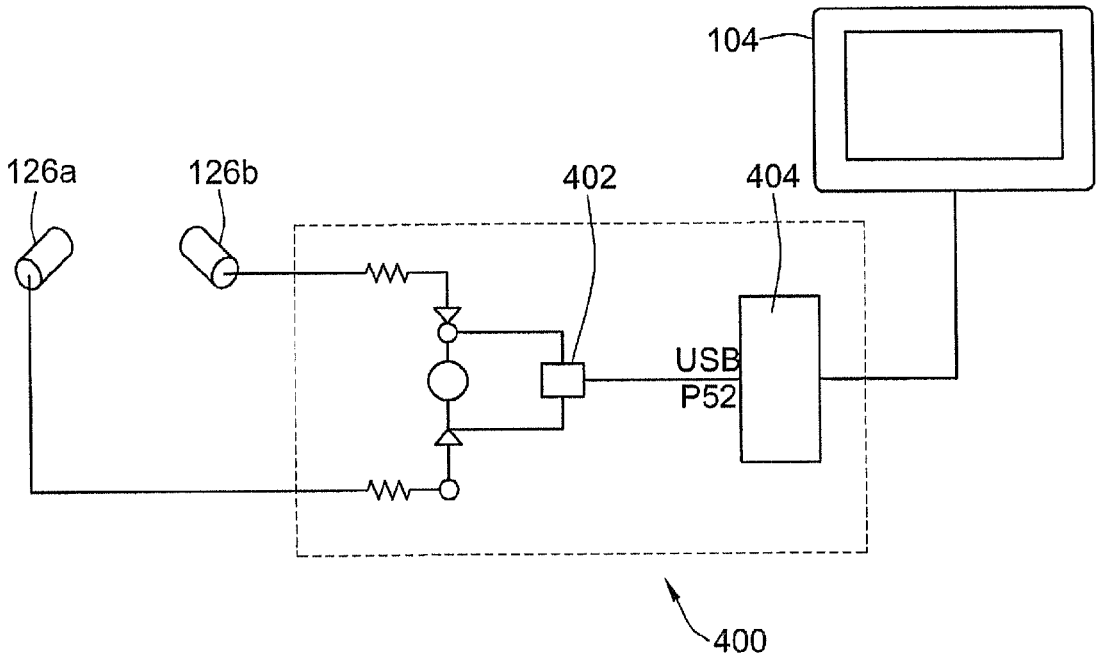
FIG. 4 illustrates a block diagram of a game acquisition circuit that is operably connected to sensors according to an embodiment of the present invention.

FIG. 4 illustrates a block diagram of a game acquisition circuit 400 that is operably connected to sensors 126*a*, 126*b* according to an embodiment of the present invention. The game acquisition circuit 400 may include an input/output board 402 and a game controller 404. The sensors 126*a*, 126*b* may provide signals indicating whether the beams 128*a*, 128*b* are detected by the corresponding sensor 126*a*, 126*b*. The signals from the sensors 126*a*, 126*b* may be filtered or processed before being received by the input/output board (IOB) 402. Additionally, the signals from the sensors 126*a*, 126*b* may undergo modulation so as to overcome noise effects from ambient light. Signals from the sensors 126*a*, 126*b* may be stored by the input/output board 402 until a predetermined number of events occur, as discussed below in more detail. Further, while at the input/output board 402, the signals from each of the sensors 126*a*, 126*b* may be combined before being sent to the game controller 404. The game controller 404 may include a processor that operates software or game code to perform calculations using the information received from the input/output board 402. For example, information received from the input/output board 402 may indicate when a beam 128*a*, 128*b* was crossed by a puck propelled down the playing field 102. This information may allow the game controller to calculate travel information for the propelled puck, including, for example, the velocity, angle of travel, and location of the puck, among others, as the puck crossed the beams 128*a*, 128*b*. The game controller 404 may then use this information to calculate a travel path for a virtual puck 406 along a virtual playing field 408 that corresponds to the travel path and ending point the actual puck may have taken had the playing field 102 been longer. The game controller 404 may also control the display of the virtual playing field 408 and virtual puck 406 on the display 104, as shown in FIG. 2. Additionally, the game controller 404 may also operate automatic scoring for the game session. Further, the game controller 404 may be used for operation of the game menu and player options that may be selected through the use of the player activated button(s) 128, including the spin factor added to the virtual puck 406.

Figure 5A:
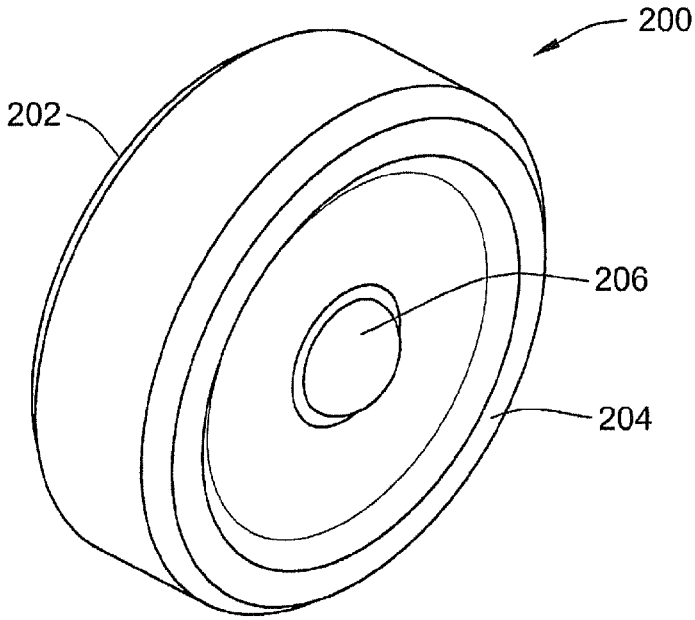
FIG. 5*a* illustrates a perspective view of a puck for use with the gaming apparatus according to an embodiment of the present invention.

FIG. 5*a* illustrates a perspective view of a puck 200 for use with the gaming apparatus 100 according to an embodiment of the present invention. The puck 200 may include an upper surface 202, a lower surface 204, and one or more ball bearings 206 that are configured to reduce the friction between a puck 200 and the surface of the playing field 102 as the puck 200 is propelled along the playing field 102. The bearings 206 may be operably secured into the puck 200, such as, for example, by a press fit, retaining rings, or cap, or can be integrated into the body of the puck 200, such as, for example, by the semi-spherical race portions of the bearing unit(s) being integrated into the body of the puck 200. According to an embodiment of the present invention, one steel omnidirectional ball bearing 206 is centrally mounted on the puck 200 and protrudes slightly beyond the lower surface 204 of the puck 200, thereby reducing the portion of the bottom surface 204 of the puck 200 that comes into contact with the playing field 102 as the puck 200 moves along the playing field 102. According to other embodiments, the puck 200 may be operably connected to multiple ball bearings 206, such as, for example, three ball bearings 206, that are arranged to prevent the bottom surface 204 of the puck 200 from contacting the playing field 102 as the puck 200 is propelled during game play towards the distal end 108 of the playing field 110.

Additionally, the puck 200 may be constructed from material that has a low friction coefficient respective to the playing field 102. According to one embodiment, the puck 200 is constructed from a plastic material, such as, for example, Delrin, among others. According to another embodiment, at least a portion of the puck 200 that comes into contact with the playing field 102 during game play may be constructed from material having a lower coefficient of friction relative to the surface of the playing field 102 than material(s) used to construct other portions of the puck 200. For example, according to an embodiment, the lower surface 204 may be constructed from a material having a lower coefficient of friction than the material used to construct other portions of the puck 200, such as the upper surface 202 and/or outer perimeter of the puck 200. Alternatively, the outer surface of the lower surface 204, also referred to as the lower surface outer perimeter, that comes into contact with the playing field 102 may be constructed of a material having a lower coefficient of friction than other portions of the puck 200, such as the upper surface 202, outer perimeter, and/or other portions of the lower surface 204. Alternatively, a material having a low coefficient of friction may be attached or adhered to surfaces of the puck 200 that may come into contact with the playing field 102 during game play. According to an embodiment of the present invention, the puck 200 may have an approximately 3 inch diameter and a width of approximately 15/16 inch. However, traditional pucks and silicone beads can also be used with the gaming apparatus 100 of the present invention. Further, as the present invention may be used for a number of different games, including bowling and skee ball, as previously mentioned, according to other embodiments of the present invention, the puck may take other shapes than that shown in FIG. 5, including, for example, being round or ball-shaped.

Figure 5B:
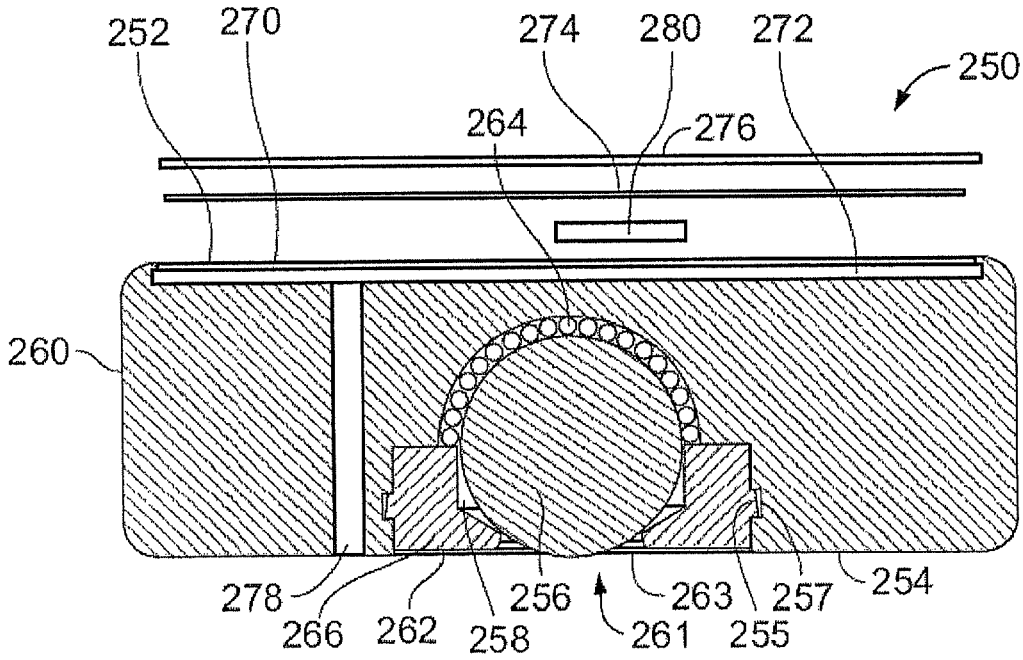
FIG. 5*b* illustrates a partial exploded cross-sectional view of a puck for use with the gaming apparatus according to an embodiment of the present invention.

FIG. 5*b* illustrates a partial exploded cross-sectional view of a puck 250 for use with the gaming apparatus 100 according to an embodiment of the present invention. The puck 250 has an upper surface 252, a lower surface 254, and at least one load ball 256. The puck 250 may also include at least one aperture 258 configured to house at least a portion of the load ball 256. According to the embodiment illustrated in FIG. 5*b*, the aperture 258 may be in a generally central location along the length of the puck 250. However, in other embodiments, the aperture 258 may be located at other positions about the puck 250, such as, for example, closer to an outer perimeter 260 of the puck 250. Further, the puck 250 may include a plurality of apertures 258, each configured to house at least a portion of at least one load ball 256. For example, according to an embodiment of the invention, at least two load balls 256 may be at least partially housed in separate apertures 258 in the puck 250. Further, the load balls 256 may, for example, be equally spaced from each other or from neighboring load balls 256 and from the center of the puck 250.

According to an embodiment, the load ball 256 may be part of a bearing 261 that also includes a plurality of secondary balls 264 and a ball retainer 266. For example, the load ball 256 may be part of an inversely mounted transfer bearing that is inserted into the puck 250 through an orifice 262 in the lower surface 254, as illustrated in FIG. 5*b*. The load ball 256 may be freely coupled to the puck 250 and rotate along the plurality of smaller secondary balls 264, such as, for example, recirculating ball bearings, so that the puck 250 travels along the surface of the playing field 102 in a non-skewed trajectory. According to one embodiment, at least a portion of the body of the puck 250 may be configured to provide a bearing raceway for the secondary balls 264. At least a portion of the load ball 256 and secondary balls 264 may be secured within the puck 250 by the ball retainer 266. As illustrated by the embodiment in FIG. 5*b*, the ball retainer 266 may include an opening 263 through which at least a portion of the load ball 256 may protrude through the ball retainer 266 and beyond the lower surface 254 of the puck 250. Further, the ball retainer 266 may be operably secured to the puck 250, such as, for example, through the use of press fit, retaining ring, or mechanical fasteners, including, for example, a screw, bolt, or pin, among others. The ball retainer 266 may also include a rib 255 that fits into a channel 257 in the aperture 258 to assist with securing the ball retainer 266, and thus load ball 256 and secondary balls 264, in the puck 250.

The upper surface 252 of the puck 250 may include an outer groove 270 and an inner groove 272. The inner groove 272 may also be configured to receive the insertion of a disc 274, such as a generally round shaped disc 274 that may include or be attached to graphic material, such as printed information, advertisement, or logo, among others. The outer groove 270 may be configured to receive the insertion of a cover 276. According to an embodiment, the cover 276 may be removably secured to the puck 250, such as by a snap fit into inner grove 272 or through the use of mechanical fasteners, including adhesives, screws, pins, or bolts, among others. The cover 276 may be made from the same or different material than the lower surface 254 of the puck 250. Further, according to an embodiment, the cover 276 may be at least semi-transparent so as to allow at least a portion of the top of the disc 274 to be viewable when the cover 276 and disc 274 are inserted in the outer and inner grooves 270, 272, respectively. Additionally, the puck 250 may include at least one access hole 278 that may allow for the insertion of tool or other object to remove the cover 276 and/or disc 274.

According to an embodiment, the outer diameter of the puck 250 may be made approximately 3 times larger than the diameter of the load ball 256. For example, according to an embodiment, the puck 250 may have an outer diameter of approximately 3 inches and a thickness of approximately 15/16 inches, while the load ball 256 and secondary balls 264 may have diameters of approximately ¾ inches and 1/16 inches, respectively. The load ball 256 and secondary balls 264 may be constructed from a variety of relatively hard materials, including, for example, steel, plastic, and rubber. Further, the load ball 256 may be constructed from a material harder than the material of the secondary balls 264.

The load ball 256 may protrude far enough away from the puck 250 so that the puck 250 is relatively stable as it travels down the surface of the playing field 102. According to some embodiments, a portion of the load ball 256 protruding through the orifice 262 may extend about 0.015 inches beyond or away from the lower surface 254. By protruding slightly out of the puck 250, the load ball 256 may minimize and/or eliminate the amount of the lower surface 254 of the puck 250 that contacts the surface of the playing field 102, and thereby reduce the amount of friction between the puck 250 and the surface of the playing field 102. For example, if the puck 250 includes a plurality of load balls 256, such as, for example, three load balls 256 that are equally spaced from the center of the puck 250, the lower surface 254 may not come into contact with the surface of the playing field 102 as the puck 250 travels down the playing field 102.

Figure 5C:
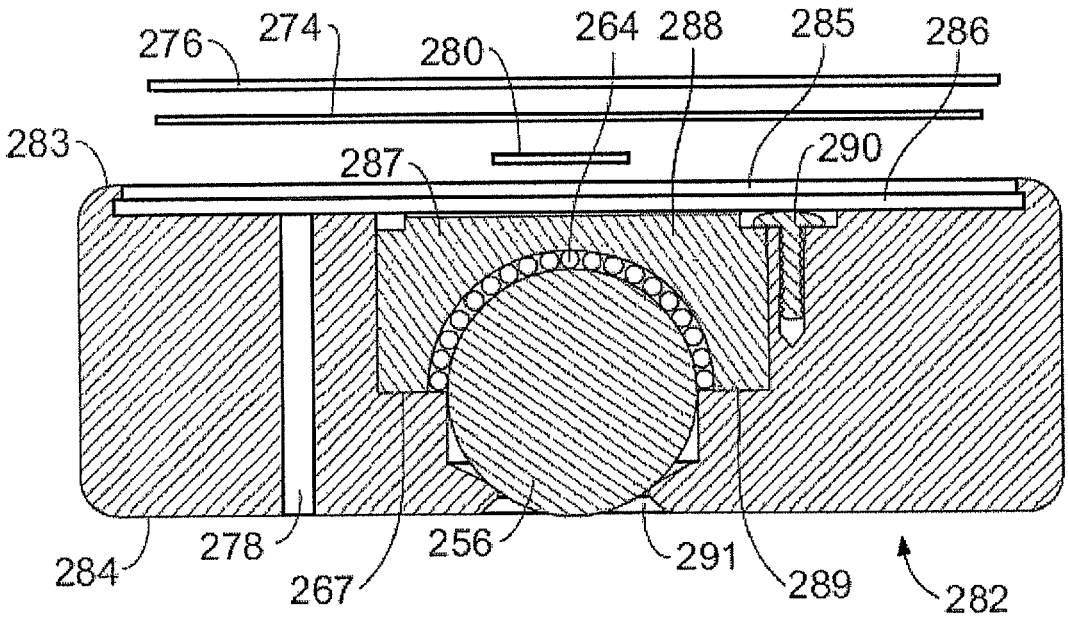
FIG. 5*c* illustrates a partial exploded cross-sectional view of a puck for use with the gaming apparatus according to an embodiment of the present invention.

FIG. 5*c* illustrates a partial exploded cross-sectional view of a puck 282 for use with the gaming apparatus 100 according to an embodiment of the present invention. The puck 282 includes an upper surface 283 and a lower surface 284. The upper surface 283 may include outer and inner grooves 285, 286 that may be sized to allow for the insertion of a ball retainer 287 and/or the insertion of a bearing into the aperture 288. As shown by FIG. 5*c*, according to an embodiment, the ball retainer 287 may be, or include, a bearing raceway. The ball retainer 287 may be secured to the puck 282 through the use of at least one mechanical fastener 290, such as a screw, bolt, snap ring or pin, among others.

The aperture 288 may include a flange, protrusion, or shoulder 289 upon which at least a portion of the ball retainer 287 may generally abut. The removable cover 276 and disc 274 may allow for adjustments to be made to the puck 250. For example, one or more shims or spacers (not shown) may be placed, or removed from, between the shoulder 289 in the aperture 288 and the ball retainer 287, thereby raising or lowering the load ball 256 into or out of the puck 250 so as allow for an adjustment in the distance that at least a portion of the load ball 256 protrudes out of an orifice in the lower surface 284 of the puck 282.

Additionally, an identifier 280 may be removably placed in or on, or molded into, the puck 250, 282. For example, the identifier 280 may be placed inside the puck 250, such as, for example, between the disc 274 and the body of the puck 250. According to another embodiment, the identifier may be positioned between the disc 274 and the ball retainer 287. According to another embodiment, the identifier 280 may be placed on or attached to the cover 276 or the disc 274. Further, according to some embodiments, the identifier 280 may be removable so that an identifier 280 may correspond to a specific player or team. The identifier 280 may allow for the automatic detection of game play information associated with the puck 250, 282, player, and/or team. For example, the identifier 280 may be used to detect whether game play credits are available for that puck 250, 282 or player to allow game play to commence, or whether game play is commencing so that the credits are to be deducted from the appropriate account. Further, the identifier 280 may be used for allocating scoring, such as identifying a scoring play with a particular player or team and keeping track of game score during play.

The identifier 280 may be detected by a sensor or may record game play information and later communicate that information to the gaming machine 100 or a game system. Examples of identifiers 280 include, but are not limited to, a microchip, radio frequency identification (RFID) chip, magnet, or ultrasonic emitter. Additionally, the puck 250, 282, including the cover 276 or disc 274, may have an optical identifier, such as, for example, a bar code, number, or color, among others, that is detected by an optical sensor.

FIG. 6 illustrates a representation of a puck 200 traveling along a playing field 102 according to an embodiment of the present invention. The embodiment in FIG. 6 illustrates the transmitters 124*a*, 124*b* and corresponding sensors 126*a*, 126*b* being angled towards each other. Further, the beam 128*a*, 128*b* transmitted from each transmitter 124*a*, 124*b* may intersect each other at the horizontal center point of the playing field 102 and at half the distance between a transmitter 124*b* and the sensor 126*a* on the same side rail 116. The intersection of the beams may have an angle of 45 degrees, 22.5 degrees, 11.25 degrees, or 6.125 degrees, although almost any angle is usable. According to an embodiment of the present invention, if a beam 128*a*, 128*b* is blocked or is not read by the sensor 126*a*, 126*b* for a predetermined period of time, a warning message may be displayed for the players to see that game play has been interrupted. For example, if a player places his hand on the housing 110 for a period of time so as to interfere with a beam 128*a*, 128*b* being received or sensed by the corresponding sensor 126*a*, 126*b*, or the transmitter 124*a*, 124*b* is misaligned with the corresponding sensor 126*a*, 126*b*, the warning may indicate that a corrective action is necessary before game play may resume.

Additionally, the game controller 404 may provide the option for angle correction. Angle correction may be used to calibrate the angle of beam intersection, for example during the initial set-up of the gaming apparatus 100 so as to allow for more precise calculation of the angle of travel, velocity, and location of a puck 200 that crosses the beams, as discussed below in more detail. For example, a card may be provided that is placed at the distal end 108 of the playing field 102 that has markings as to where a beam should been seen if, for example, the beams are to intersect at 11.25 degrees. The card may include other indicia to provide information for each beam as to the degree of offset or variance of the beam from the intended angle of intersection that may then be inputted into the game controller 404. For example, according to embodiments of the invention, if the beams are to intended to, and in fact do, intersect at an 11.25 angle, the card will indicate an angle offset of "0". However, if the angle of the transmitted beam is offset, the card may provide offset values, for example ranging from −5 to +5, that may used to indicate to the game controller 404 the offset of the angle of the beam.

Figure 7:
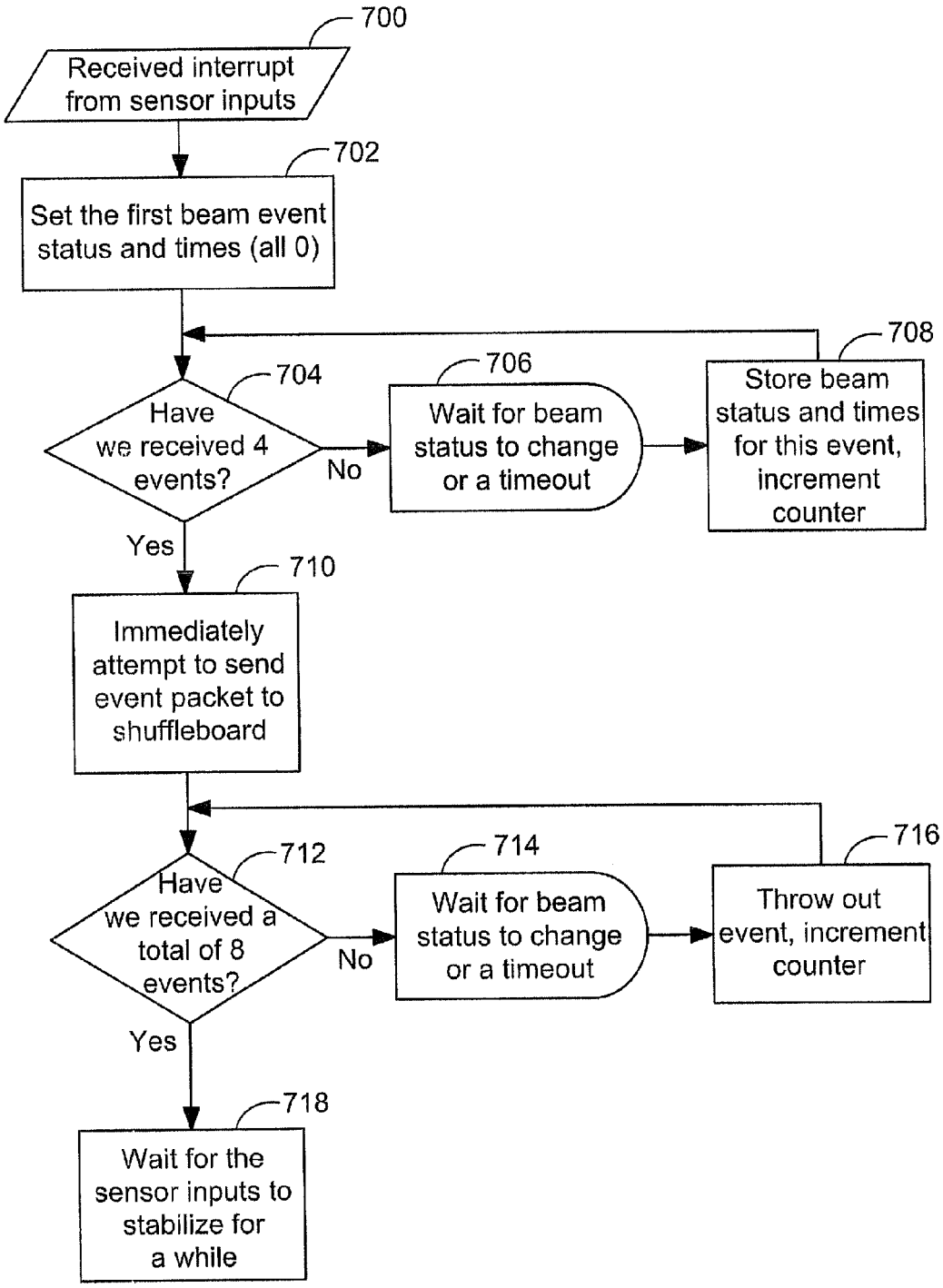
FIG. 7 illustrates a flow chart of an input/output board time diagram according to an embodiment of the present invention.

FIG. 7 illustrates a flow chart of an input/output board 402 time diagram according to an embodiment of the present invention. At 700, an input/output board 402 receives an interrupt signal from a sensor 126*a*, 126*b* indicating that a beam 128*a*, 128*b* being transmitted to that sensor 124*a*, 124*b* has been obstructed by a puck 200 that the player has propelled along the playing field 102 of the gaming apparatus 100. Before the puck 200 reaches any of the beams 128*a*, 128*b*, the beams 128*a*, 128*b* are unobstructed by the puck so that the beams 128*a*, 128*b* transmitted by the transmitters 124*a*, 124*b* are received or sensed by the associated sensors 126*a*, 126*b*. Which beam 128*a*, 128*b* is first obstructed, or whether both beams 128*a*, 128*b* are simultaneously broken, and when each beam 128*a*, 128*b* is not obstructed, depends at least on the location and orientation of the transmitters 124*a*, 124*b* and the location and angle of travel of the propelled puck 200 on the playing field 102. When a beam 128*a*, 128*b* ceases to be interrupted so that the beam status returns to unobstructed, a signal from the sensor at 700 will indicate, or provide, an uninterrupted signal.

At 702, the input/output board 402 sets the first beam event status and time. An event occurs when there is a change in beam status, namely a change in a beam status of a beam 128*a*, 128*b* from unobstructed to obstructed. For example, if the first beam 128*a* is obstructed by the puck 200 before the second beam is obstructed by the puck 200, the first event has the first beam status for the first beam 128*a* as obstructed, while the second beam status for the second beam 128*b* is unobstructed. Upon the occurrence of the first event, the first event may be equated to a time, which, for the first event may be set at zero.

At 704, the input/output board 402 may inquire as to whether 4 events have been received. The number of events may vary depending on the number of transmitter/sensor combinations used to detect puck 200 movement. For example, in an embodiment of the present invention in which two transmitter/sensor combinations are utilized, there may be four events, namely when the first beam 128*a* is obstructed, when the first beam 128*a* is unobstructed, when the second beam 128*b* is obstructed, and when the second beam 128*b* is unobstructed. Each event is equated to a time, indicating when that event occurred. The time for each event may be the actual time the event occurred, or may be a lapse in time after the first event occurred or after the preceding event occurred. The first beam 128*a*, 128*b* to be broken may indicate what side of the playing field 102 that the propelled puck 200 is located.

If the predetermined number of events has not yet occurred, then at 706 the input/output board 402 may wait for a change in a beam status for either beam 128*a*, 128*b*, or for the expiration of a predetermined period of time or timeout. If a timeout occurs, any events stored in the input/output board may be removed or erased. At 708, the input/output board 402 may store the beam statuses and time for the event and increment the counter, which reflects the number of events that have occurred. This same process may repeat itself until all four events have occurred. For example, the second event may have the first and second statuses for the first and second beams 128*a*, 128*b* as obstructed and may have an event time of 54000 μs after the first event; the third event may have the first beam status as unobstructed while the second beam status is obstructed and an event time of 80000 μs after the first event; and the fourth event has the first and second beam statuses as unobstructed and may be recorded as having an event time of 120 ms after the first event.

After the four events have been received by the input/output board 402, then at 710 the input/output board 402 may attempt to send an event packet, represented by the four events, to the game controller 404. The game controller 404 may not initially accept the event packet, at which point the event packet may be stored, for example, in a buffer, until the game controller 404 is ready to receive the event package. For example, the game controller 404 may be busy multitasking or running other applications or game code when the input/output board 402 initially attempts to send the event package to the game controller 404, and thus the event package may be stored until the game controller 404 is ready to receive the event package.

According to an embodiment of the invention, at 712, the input/output board 402 may inquire as to whether as to whether 8 events have occurred. The eight events may consist of the four events discussed above plus an additional four events that may occur when the puck 200 passes again through the beams 128*a*, 128*b* as it the puck 200 is propelled by the puck return 122 toward the proximate end 106 of the playing surface 102. Accordingly, there may be two additional events for both the first and second beams 128*a*, 128*b* as their beam status changes to obstructed and unobstructed as the puck 200 is returned to the proximate end 106 of the playing field 102. Again, however, the number of events may be predetermined, and may be adjusted based on a number of factors, including the number of transmitter 124*a*, 124*b* and sensor 126*a*, 126*b* combinations.

At 714, if the predetermined number of events has not occurred, the input/output board 402 may wait for a change in beam status or the expiration of a time-out period. If a change in beam status occurs before the time-out period, then at 716 the event may be thrown out, and the counter for the number of events that have occurred may be incremented. Once all eight events have occurred, then at 718 the counter may be cleared and the input/output board 402 may wait for the sensor inputs to stabilize for a predetermined time period before the process may begin again for another puck 200 that is propelled toward the distal end 108 of the playing field 102.

Figure 8:
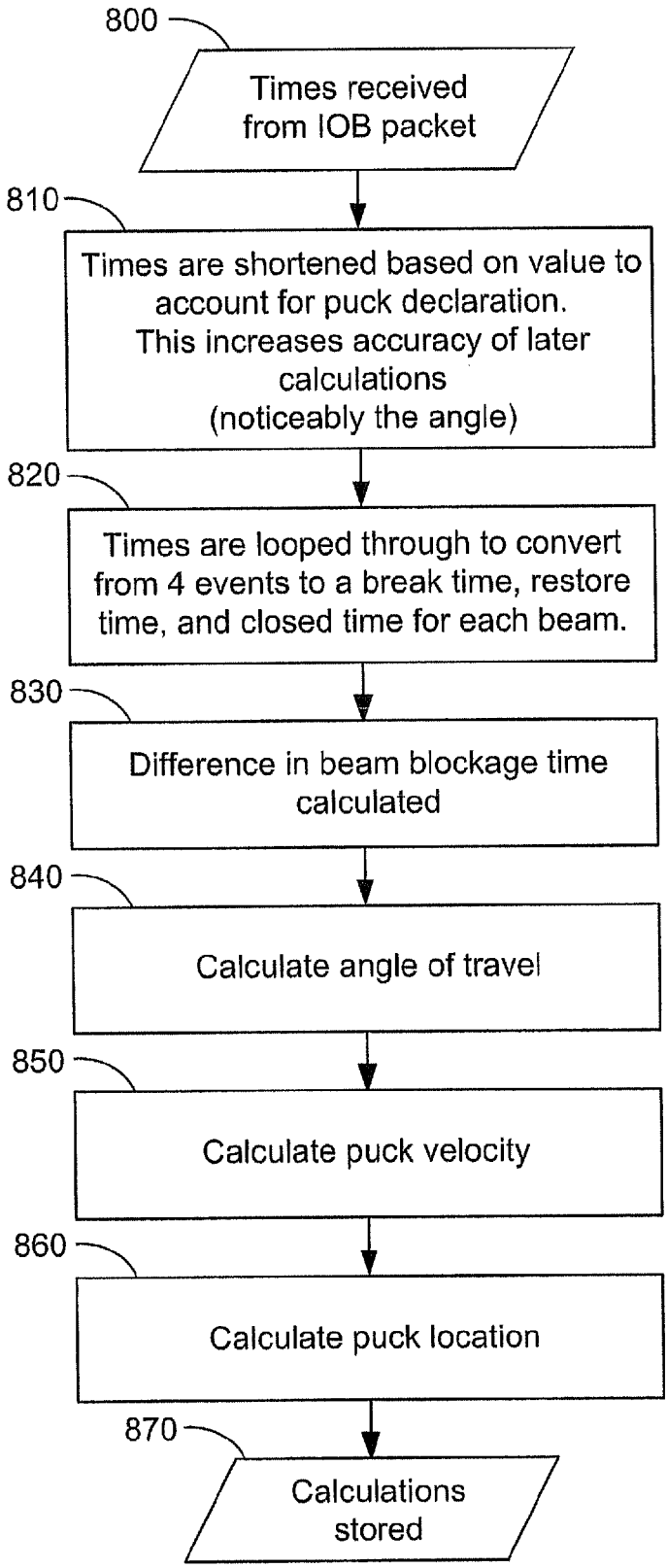
FIG. 8 illustrates a flow chart of calculations performed by the game controller.

FIG. 8 illustrates a flow chart of calculations performed by the game controller 404. At 800, the game controller 404 receives the events from the input/output board 402 discussed above with respect to 710 in FIG. 7. At 810, these event times may be shortened to account for anticipated puck 200 deceleration between events. More specifically, the puck 200 is anticipated to deceleration due to at least friction between the playing field 102 and the puck 200. Accordingly, the velocity at which the puck 200 crosses the first beam 128*a* may be higher than the velocity at which the puck 200 subsequently crosses the second beam 128*b*. Accordingly, because of this potential difference in velocity, at 810 the game controller 404 may compensate for, or, alternatively, ignore this change in velocity. For example, the game controller 404 may adjust one or more event the times, such as, for example, by compressing or reducing the lapse time between events or between the first event and each subsequent event, to account for an anticipated deceleration in the velocity of the puck 200 so that a declaration in puck velocity may be negated. Moreover, the velocity of the puck 200 as it crosses both beams 128*a*, 128*b* may be treated as constant. Such adjustments in event times may improve the accuracy of the calculations for angle of travel and location of the puck 200.

At 820, the time associated with each event is converted to a restore time and a break time for each beam. The restore time is the time when the beam status of a beam 128, 128*b* is changed to obstructed. The break time is when the beam status of a beam 128*a*, 128*b* is changed to unobstructed.

At 830, the difference in the duration of time that a beam 128*a*, 128*b* was obstructed or unobstructed is determined. Therefore, for example, the beam blockage time ($beam_1$time) for the first beam 128*a* is the difference in time between the restore time and the break time for the first beam 128*a*. Likewise, the beam blockage time ($beam_2$time) for the second beam 128*b* is the difference in time between the restore time and the break time for the second beam 128*b*. The difference between the $beam_1$time and $beam_2$time may be used to determine the difference in beam blockage duration ($\Delta T$).

At 840, the time calculations from 830 may be used to determine the angle of travel for the puck 200. According to an embodiment of the invention, the angle of travel ($\theta$) for the puck 200 may be calculated by the game controller 404 using at least the following formulas:

$$r = \frac{beam_1 time}{beam_2 time}$$

$$\theta = \text{atan}\left(\frac{\frac{r-1}{-r-1}}{\tan(beamAngle)}\right)$$

where the beamAngle is the angle of the intersection of the beams 128*a*, 128*b* in radians.

At 850, the time information from 830 and angle of travel from 840 may be used by the game controller 404 to calculate a puck velocity. According to an embodiment of the present invention, the velocity of the puck 200 may be calculated using at least the following equations:

$$n_1 = \text{abs}\left(\frac{1}{\cos(\theta + beamAngle)}\right)$$

$$n_2 = \text{abs}\left(\frac{1}{\cos(\theta - beamAngle)}\right)$$

$$\text{velocity} = \frac{n_1 + n_2}{beam_1 time + beam_2 time} * \phi_{puck}$$

where $\phi_{puck}$, is the diameter of the puck 200.

At 860, the time information and velocity and angle of travel calculations may be used by the game controller 404 to calculate the location (X) the puck 200 travels through the beams 128*a*, 128*b*. According to an embodiment of the present invention, the location (X) may be based on, and represent, the distance the puck 200 is offset from the center of the playing field 102 and/or the intersection of the beams 128*a*, 128*b*. For example, according to an embodiment of the invention, the center of the playing field 102 may be designated by a zero location, and a puck 200 located to the right of the center may have a positive location value, while pucks to the left of center may be assigned a negative location value. Specifically, according to an embodiment of the present invention, the playing field 102 may have a width of approximately 20.25 inches, and therefore the right side of the playing field 102 may extend to a location value of 10.125 inches, while the left side of the playing field 102 may extend to a location value of −10.125 inches. According to an embodiment of the present invention, the location of the puck 200 may be calculated using at least the following equations:

$$\alpha = \left(\frac{beam_1 time}{2} - \left(\Delta T + \frac{beam_2 time}{2}\right)\right) * \text{velocity}$$

$$X = \frac{\frac{\alpha}{2}}{\tan(beamAngle)}$$

At 870, the velocity, angle or travel, and location (travel path information) may be stored, such as, for example, in a 1-puck buffer, until the game controller 404 is ready for this information. For example, the game controller 404 may not be ready to use the travel path information as the game controller 404 may be in the process of multitasking or processing other game program code, such as, for example, performing physics calculations or refreshing contents on the display 104, among others. The game controller 404 may also be in a mode where it is ignoring any pucks 200 thrown, such as, for example, when the player is making menu selections through operation of the player activated buttons 128 or when the camera view of the virtual playing field 408 displayed on the display 104 is not at a starting position. Additionally, if the travel path information for a subsequently thrown puck 200 is received for storage at 860, the stored travel path infatuation for an earlier thrown puck 200 may be overwritten before that travel path information for the earlier thrown puck 200 has been used by the game controller 404. However, if the game controller 404 is immediately ready to receive the travel path information, step 870 may be skipped.

Figure 9:
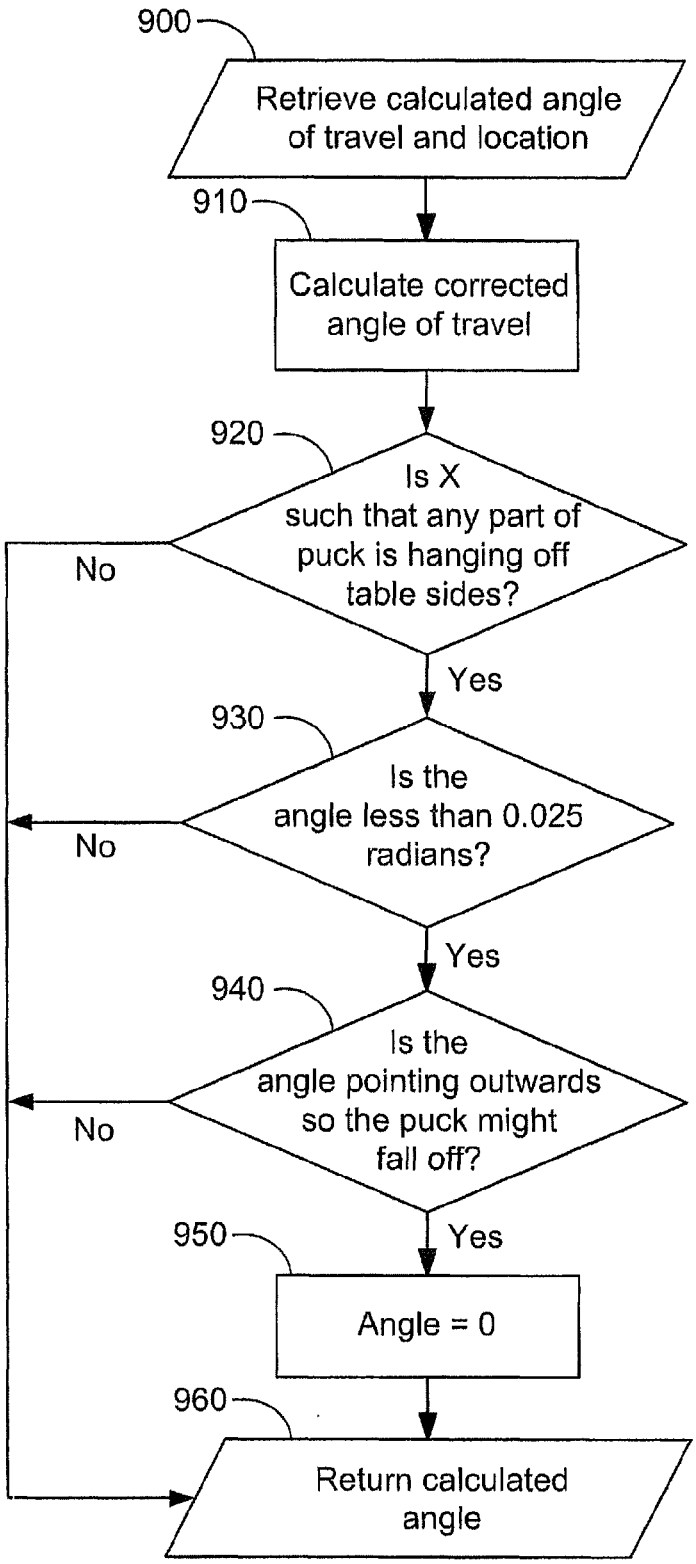
FIG. 9 illustrates a flow chart of a method of correcting potential inaccuracies in the calculated value for the angle of travel of the puck.

FIG. 9 illustrates a flow chart of a method of correcting potential inaccuracies in the calculated value for the angle of travel of the puck 200 discussed above with respect to FIG. 8. The calculations discussed with respect to FIG. 8 and FIG. 9 may be performed by the same or different sections of the game code or software. Further, angle correction, which is performed by the game controller 404, may be necessary for some types games, and particularly when relatively high angles of travel occur at relatively high locations, such as when the puck 200 is propelled along the side of the playing field 102 so that at least a portion of the puck is close to, or extends over, a gutter located along a side of the playing field 102. Accordingly, for those games in which angle correction is performed, then at 900, the calculated angle of travel and the location of the puck 200, as discussed above in FIG. 8 at 840 and 860, is retrieved from, for example, a storage buffer. At 910, a corrected angle of travel (θ') may be calculated for each puck 200 propelled along the playing field. According to one embodiment of the present invention, the corrected angle of travel may be calculated using the following equation:

$$\theta' = \frac{\theta}{\frac{1}{\frac{10 - \mathrm{abs}(X)}{20}} - 1}$$

However, according another embodiment of the present invention, a corrected angle of travel at 910 may be calculated using an adjustment factor (adjustmentFactor). The adjustment factor may be utilized in an attempt to offset the potential effect deceleration of the puck 200 as the puck 200 crosses different beams 128*a*, 128*b* may have on the accuracy of the calculations. For example, the calculations for a puck 200 that is traveling along the edge of the playing field 102 may be less accurate than calculations for a puck 200 traveling along the center of the playing field 102. Specifically, the puck 200 that travels at the edge of the playing field 102 has a longer distance to travel before both beams 128*a*, 128*b* have been broken than a puck 200 traveling at the center of the playing field, and thus the puck 200 at the edge of the playing field 102 may experience more deceleration before both beams 128*a*, 128*b* have been broken. This declaration may adversely impact the accuracy of the calculations for the angle of travel of the puck 200, and other related calculations. Accordingly, a corrected angle of travel may also be calculated using an adjustment factor, such as, for example, an adjustment factor of 13.0, as in the following equation to attempt to offset the effect of puck 200 deceleration:

$$\theta' = \frac{\theta}{\frac{1}{\frac{adjustFactor - \mathrm{abs}(X)}{adjustFactor}}}$$

Further, in instances when the puck 200 is traveling at relatively higher velocities, the impact of deceleration of the velocity of the puck 200 on the accuracy of calculated speeds and location may be minimized. In such events, the corrected angle (θ') at 910 may be calculated using at least the following equation:

$$\theta' = \theta * \frac{100 - \min_{(velocity,100)}}{75}$$

At 920, an inquiry is made by the game controller 404 as to whether the location (X) places any part of the puck over the side of the playing field 102. If the answer is no, then at 960 the corrected angle of travel may be used by the game controller for the virtual puck 406. If the answer is yes, then at 930, the inquiry is whether the corrected calculated angle of travel is less than 0.025 radians. If the answer is no, then at 960 the corrected angle of travel may be used by the game controller 404 for the virtual puck 406. If the answer is yes, then at 940, the game controller 404 determines whether the travel angle is pointing outwards from the playing field 102 so that the puck 200, or the virtual puck 406, may fall off of the playing field 102 and into the gutter. If the answer is no, then at 960 the angle of travel may be used. However, if the answer is yes, then at 950 the corrected angle of travel may be assigned a value of "0" radians so that the virtual puck 406 may remain on the virtual playing field 408.

The gaming controller then may utilize the results of the angle of travel (or corrected angle of travel where applicable), velocity, and location to determine a travel path for the virtual puck 406 along the virtual playing field 408, which may be displayed on the display 104. Further, using the calculated location, angle or corrected angle of travel, and velocity of the puck 200, the game controller 404 may determine the location at which the virtual puck 406 will come to rest, or stopping location, on the virtual playing field 408, and whether that resting place is in the virtual scoring zone. During subsequent throws of pucks 200, the game controller 404 may determine if another virtual puck 406*a* is in the path of a later virtual puck 406*b*, and thus whether the virtual pucks 406*a*, 406*b* will collide, the path of each virtual puck 406*a*, 406*b* after the collision, the place at which each virtual puck 406*a*, 406*b* will come to rest on the virtual playing field 408 after the collision, and whether either puck 406*a*, 406*b* has been removed from or placed on a virtual scoring zone. The game controller 404 will also tabulate a score for those pucks 406*a*, 406*b* that are at rest in or on the virtual scoring zone.

The game controller 404 may also be programmed to add effects or variances to the travel path of the virtual puck 406. For example, the virtual portion of the gaming apparatus 100 may simulate the presence and effect on the virtual puck 406 of a silicone bead pattern on the virtual playing field 408. Accordingly, after each puck is propelled, any simulated silicone bead pattern on the virtual playing field 408 may be altered by the calculated path of the virtual puck 406 to mimic the change of the silicone bead pattern that would occur on a traditional shuffle board table.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A puck for playing a gaming apparatus, the puck comprising:

an upper surface and a lower surface, the upper surface including an outer grove configured to receive the removable insertion of a cover, the lower surface including an orifice; and a ball retainer secured within an aperture in the puck, the ball retainer having an opening, a load ball, and a plurality of secondary balls, the plurality of secondary balls positioned against at least a portion of an outer surface of the load ball, at least a portion of the load ball protruding outside the puck through the opening and beyond the lower surface of the puck, the load ball being configured to rotate as the puck travels along a playing field of the gaming apparatus, the ball retainer includes having a rib that is configured to fit in a channel in the aperture.

2. A puck for playing a gaming apparatus, the puck comprising:

an upper surface and a lower surface, the upper surface including an outer grove configured to receive the removable insertion of a cover, the lower surface including an orifice; and a ball retainer secured within an aperture in the puck, the ball retainer having a load ball and a plurality of secondary balls, the plurality of secondary balls positioned against at least a portion of an outer surface of the load ball, at least a portion of the load ball protruding outside the puck, the load ball being configured to rotate as the puck travels along a playing field of the gaming apparatus, at least a portion of the lower surface being constructed from a material having a lower coefficient of friction than the material of the playing field, the upper surface having an inner groove configured to receive the removable insertion of a disc that is configured to be positioned beneath the cover, the cover being is at least semi-transparent.

3. A puck for playing a gaming apparatus, the puck comprising:

an upper surface and a lower surface, the upper surface including an outer grove configured to receive the removable insertion of a cover, the lower surface including an orifice;

a ball retainer secured within an aperture in the puck, the ball retainer having a load ball and a plurality of secondary balls, the plurality of secondary balls positioned against at least a portion of an outer surface of the load ball, at least a portion of the load ball protruding outside the puck, the load ball being configured to rotate as the puck travels along a playing field of the gaming apparatus; and an identifier to associate game play information with either the puck or a player, the identifier configured to be detected by a sensor.

4. The identifier of claim 3 wherein the game play information associated with either the puck or the player indicates whether credits are available to allow for game play with the puck.

5. The puck of claim 3 wherein the outer diameter of the puck is approximately three times larger than the diameter of the load ball.

6. A puck for playing a gaming apparatus, the puck comprising:

an upper surface and a lower surface, the upper surface including an outer grove configured to receive the removable insertion of a cover, the lower surface including an orifice; and a ball retainer secured within an aperture in the puck, the ball retainer having a load ball and a plurality of secondary balls, the plurality of secondary balls positioned against at least a portion of an outer surface of the load ball, at least a portion of the load ball protruding outside the puck, the load ball being configured to rotate as the puck travels along a playing field of the gaming apparatus, the ball retainer is being placed on a shoulder inside an aperture in the puck, the shoulder being configured to receive the placement or removal or spacers to adjust the distance that at least a portion of the load ball protrudes outside of the puck.

7. A puck for playing a gaming apparatus, the puck comprising:

an upper surface, the upper surface having an outer groove configured to receive the insertion of a removable cover;

a lower surface, the lower surface having an orifice;

a load ball, at least a portion of the load ball secured in an aperture in the puck, at least a portion of the one load ball protruding beyond the lower surface of the puck, the load ball positioned at a generally central location along the length of the puck;

a plurality of secondary balls positioned against at least a portion of an outer surface of the load ball, the secondary balls configured to assist with the rotation of the load ball as the puck travels along a playing field of the gaming apparatus; and a ball retainer operably secured in the aperture in the puck, the ball retainer configured to retain at least a portion of the load ball and the plurality of secondary balls between the upper and lower surfaces, the ball retainer is being placed on a shoulder inside the aperture, the shoulder being configured to receive the placement or removal of spacers to adjust the distance that at least a portion of the load ball protrudes outside of the puck.

8. The puck according to claim 7 wherein at least a portion of the lower surface is constructed from a material having a lower coefficient of friction than the material of the playing field.

9. The puck of claim 7 wherein the ball retainer includes an opening through which at least a portion of the load ball may protrude through the ball retainer and beyond the lower surface of the puck.

10. A puck for playing a gaming apparatus, the puck comprising:

an upper surface, the upper surface having an outer groove configured to receive the insertion of a removable cover;

a lower surface, the lower surface having an orifice, a load ball, at least a portion of the load ball secured in an aperture in the puck, at least a portion of the one load ball protruding beyond the lower surface of the puck, the load ball positioned at a generally central location along the length of the puck;

a plurality of secondary balls positioned against at least a portion of an outer surface of the load ball, the secondary balls configured to assist with the rotation of the load ball as the puck travels along a playing field of the gaming apparatus; and an identifier to associate game play information with either the puck or a player, the identifier configured to be detected by a sensor.

11. A puck for playing a gaming apparatus, the puck comprising:

an upper surface, the upper surface having an outer groove and an inner groove, the inner groove configured to receive the insertion of a disc, the outer groove configured to receive the insertion of a cover, a lower surface, the lower surface having at least one orifice;

at least one load ball, at least a portion of the at least one load ball secured in an aperture of the puck, at least a portion of the at least one load ball protruding through the at least one orifice to prevent at least a portion of the lower surface of the puck from touching the playing field; and a plurality of secondary balls positioned against at least a portion of an outer surface of the at least one load ball, the secondary balls configured to assist with the rotation of the at least one load ball as the puck travels along a playing field of the gaming apparatus.

12. The puck of claim 11 further including a ball retainer, the ball retainer configured to retain at least a portion of the at least one load ball and the plurality of secondary balls in the puck.

13. The puck of claim 12 wherein the ball retainer includes an opening through which at least a portion of the load ball may protrude through the ball retainer and beyond the lower surface of the puck.

14. The puck according to claim 11 wherein at least a portion of the lower surface is constructed from a material having a lower coefficient of friction than the material of the playing field.

15. The puck of claim 11 further including an identifier to associate game play information with either the puck or a player, the identifier configured to be detected by a sensor.

* * * * *